US006085469A

United States Patent [19]

Wolfe

[11] Patent Number: 6,085,469

[45] **Date of Patent: *Jul. 11, 2000**

[54] STRUCTURAL CONNECTOR SYSTEM FOR THE ASSEMBLY OF STRUCTURAL PANEL BUILDINGS

[76] Inventor: Michael J. Wolfe, 2408 Navarez Ave., Safety Harbor, Fla. 34695

[ * ] Notice: This patent issued on a continued prosecution application filed under 37 CFR 1.53(d), and is subject to the twenty year patent term provisions of 35 U.S.C. 154(a)(2).

[21] Appl. No.: 08/908,590

[22] Filed: Aug. 8, 1997

Related U.S. Application Data

[63] Continuation-in-part of application No. 08/695,034, Aug. 9, 1996, abandoned, and a continuation-in-part of application No. 08/695,035, Aug. 9, 1996, abandoned, and a continuation-in-part of application No. 08/695,038, Aug. 9, 1996, Pat. No. 5,826,380, and a continuation-in-part of application No. 08/695,037, Aug. 9, 1996, Pat. No. 5,901,514.

[51] Int. Cl.[7] ..... E04B 1/344; E04B 1/38

[52] U.S. Cl. ..... 52/71; 52/270; 52/284; 52/282.4; 52/309.9; 52/582.1; 52/640; 52/646

[58] Field of Search ..... 52/582.1, 270, 52/271, 284, 90.1, 91.1, 309.9, 640, 275, 276, 277, 278, 282.4, 71, 645, 646, 79.5

[56] References Cited

U.S. PATENT DOCUMENTS

| | | | |
|---|---|---|---|
| 2,051,707 | 8/1936 | Harrison | 52/640 X |
| 2,339,220 | 1/1944 | Crowley | 52/282.4 |
| 3,037,589 | 6/1962 | Cole | 52/212 |
| 3,296,752 | 1/1967 | Philp | 52/640 |
| 3,543,463 | 12/1970 | Cannon | 52/282.4 |
| 3,738,083 | 6/1973 | Shimano | 52/271 X |
| 4,100,704 | 7/1978 | Oogami | 52/277 X |
| 4,261,143 | 4/1981 | Rizzo | 52/91.1 X |
| 4,936,069 | 6/1990 | Hunter et al. | 52/309.9 X |
| 5,144,776 | 9/1992 | Hetzel et al. | 52/645 X |
| 5,373,678 | 12/1994 | Hesser | 52/309.9 X |
| 5,509,242 | 4/1996 | Rechsteiner et al. | 52/270 |
| 5,826,380 | 10/1998 | Wolfe | 52/640 X |

FOREIGN PATENT DOCUMENTS

| | | | |
|---|---|---|---|
| 2398852 | 3/1979 | France | 52/270 |
| 2634266 | 2/1978 | Germany | 52/71 |
| 291041 | 5/1965 | Netherlands | 52/90.1 |
| 2016574 | 9/1979 | United Kingdom | 52/71 |
| WO 93/03235 | 2/1993 | WIPO | 52/582.1 |

*Primary Examiner*—Laura A. Callo

[57] ABSTRACT

A structural connector system for the assembly of structural panel buildings is provided. The system is adapted for use in association with structural panels including roof and wall panels. The system comprises a pair of adjustable roof ridge structural connectors each having a generally U-shaped side with flat faces receiving adjacent ends of roof panels and with arched adjustable components therebetween. An adjustable eave structural connector is positioned between the upper edges of wall panels and roof panels adjacent to the periphery. The eave structural connectors have generally U-shaped sides with flat faces receiving wall panels adjacent their upper edges and with regions coupled to a roof panel with adjustment components therebetween. The base structural connectors have generally U-shaped sides with flat faces receiving opposed exterior faces of wall panels adjacent to their lower ends. Remote components are fixably positionable with respect to the base. Opening structural connectors for windows and doors are also included. They are formed with a generally U-shaped side with flat faces receiving opposed exterior faces of wall panels at the receiving wall window and door apertures and have second ends for receiving doors and windows, respectively.

1 Claim, 12 Drawing Sheets

FIG 3A
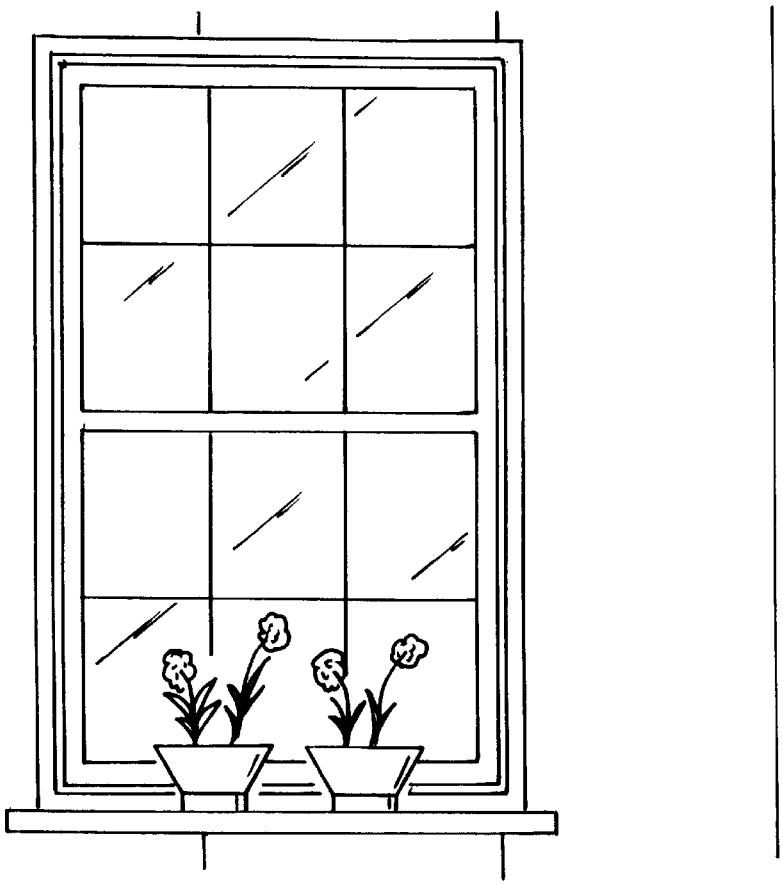
FIG 2B
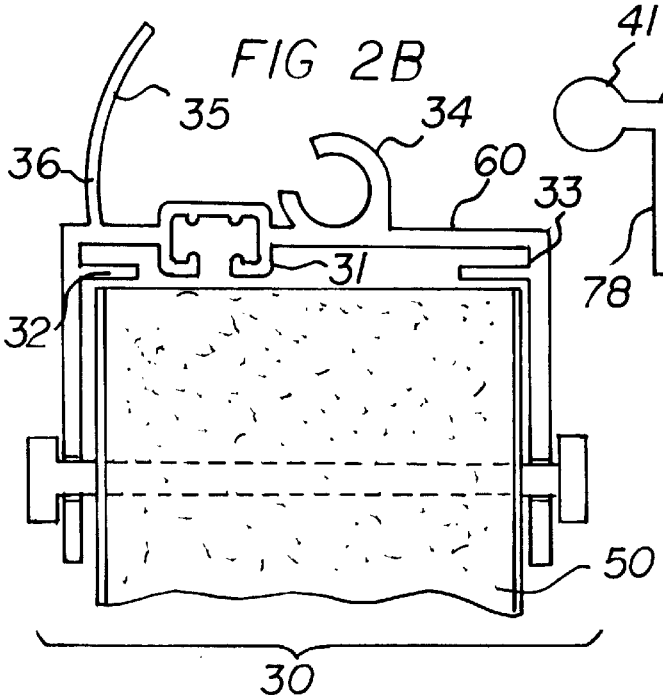
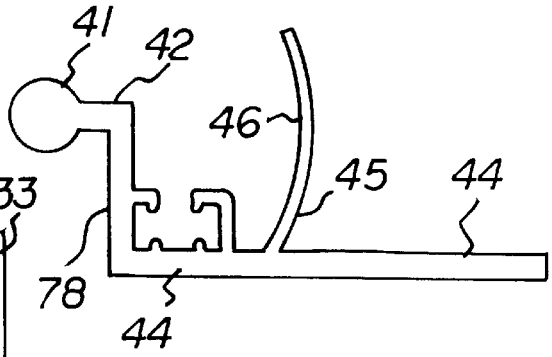
FIG 3B

FIG 2C
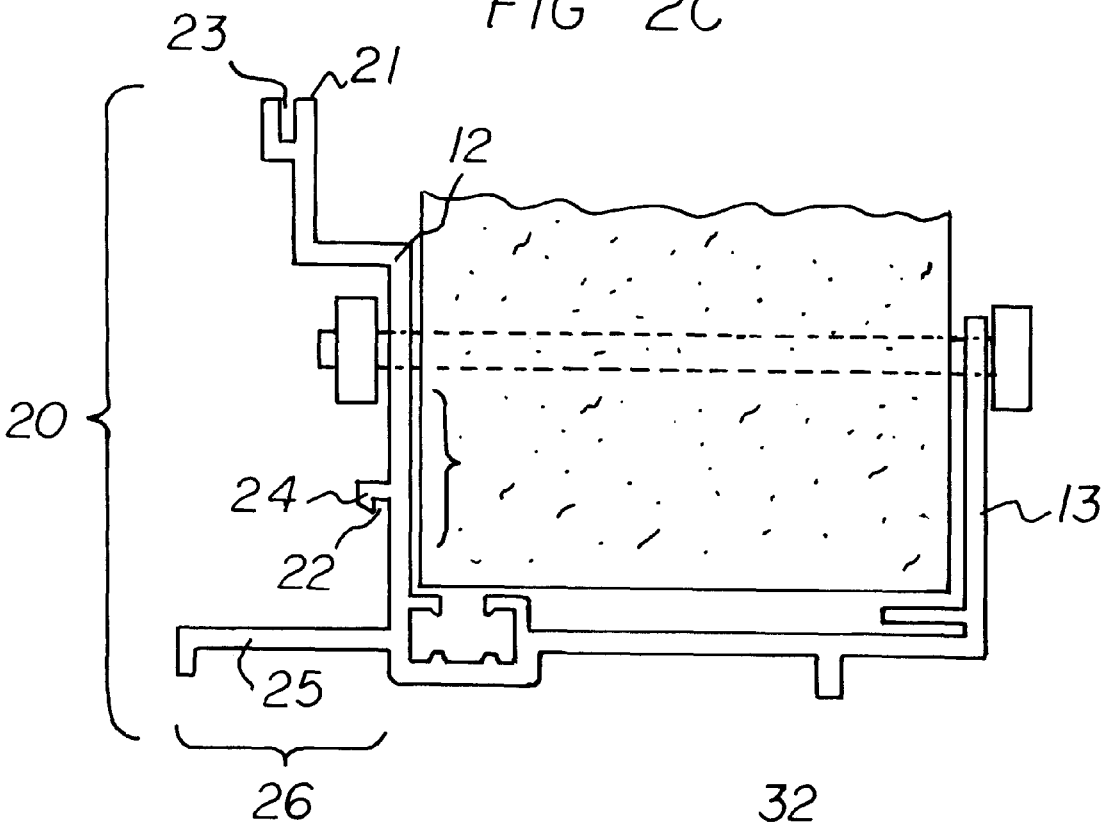
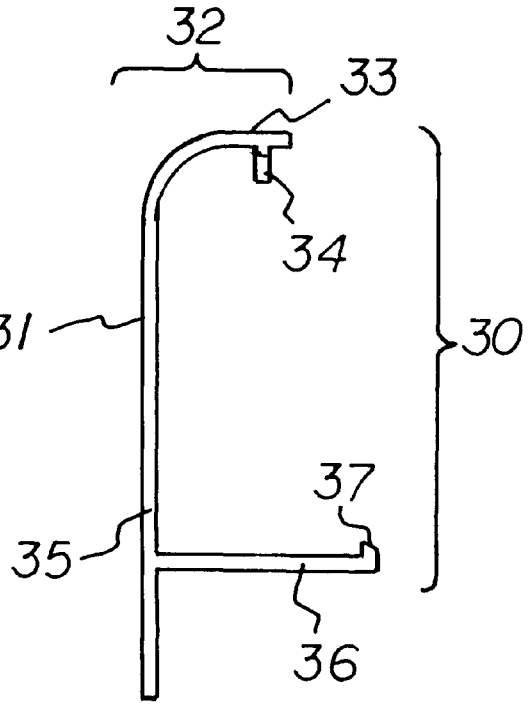
FIG 3C

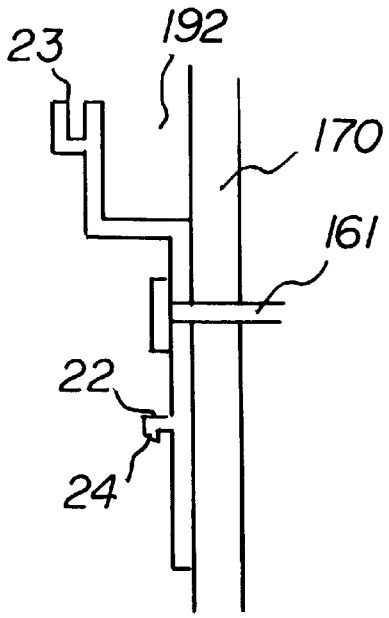
FIG 5C
FIG 6C
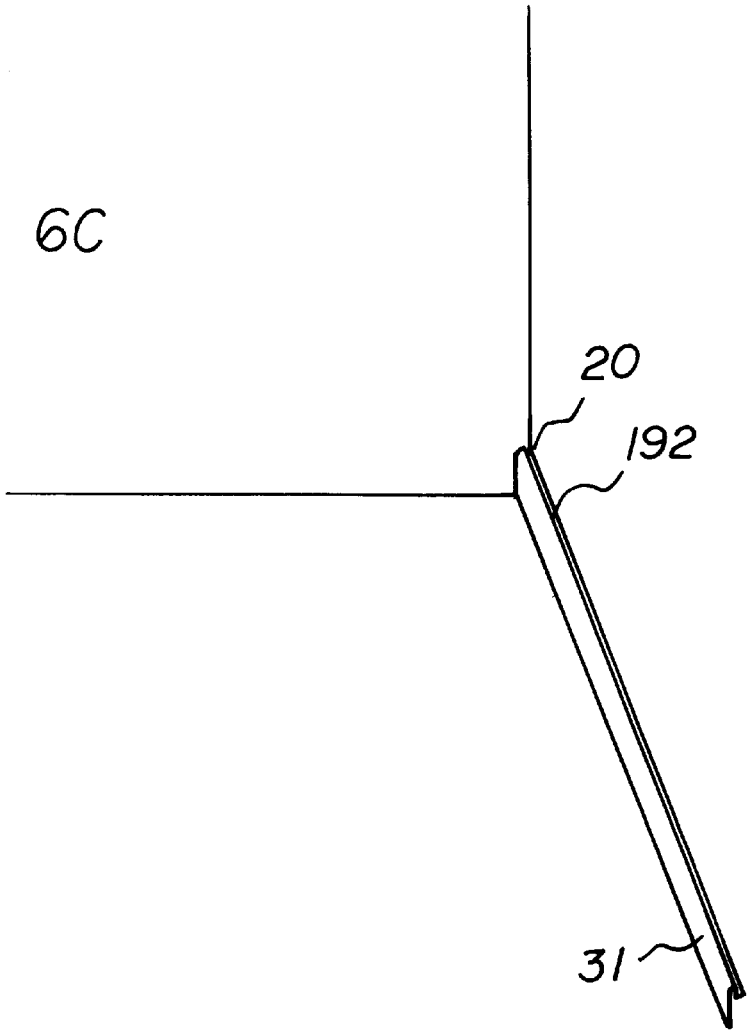

STRUCTURAL CONNECTOR SYSTEM FOR THE ASSEMBLY OF STRUCTURAL PANEL BUILDINGS

RELATED APPLICATIONS

The present application is a continuation in part application of the following four applications all filed Aug. 9, 1996: Ser. Nos. 08/695,034 now abandoned, 08/695,035 now abandoned, 08/695,037 now U.S. Pat. No. 5,901,514, 08/695,038 now U.S. Pat. No. 5,826,380.

The invention generally relates to building frame members which are adapted for receiving structural panels, particularly structural panels with sheet metal surfaces and elongated reinforcing steel members. Reference is made to Disclosure Document No. 399540, filed by the inventor on Jun. 25, 1996, which generally describes the enclosed invention, together with frame members adapted to receive similar panels in other building structures.

BACKGROUND OF THE INVENTION

U.S. Pat. No. 5,373,678, issued to Hesser on Dec. 20, 1994, teaches an improved structural panel in which a light-weight structural material is enclosed between two portions of sheet metal and the combinant panel is further strengthened by reinforcing steel bars which are housed and enclosed within the structural panel sheets.

When uniform structural panels are used to construct all or significant portions of a building, it is useful to formulate a standardized means of framing and positioning the various structural panels. A building will only be as strong as its weakest member. Accordingly, it is important to position and frame the structural panels with connecting U-shaped members which are capable of securing and holding the various portions of such building or structure and will also allow the flexibility of providing a variety of building accessories or options.

Aluminum is a useful material for constructing such building connecting members. Aluminum has high strength properties for structural metal applications, has a high resistance to corrosion, is easily fabricated, is reasonably light weight, can be welded or mechanically fastened together, and otherwise has properties making it acceptable as a building material.

Aluminum is also desirable for other reasons. For instance, it is easy to work with and fabricate frame members from aluminum. This is because various alloys or blends of aluminum can be produced to achieve specific strength of finishing properties. Once blended the aluminum can be formed into the desired configuration by the extrusion process. Extruding is a very efficient and reliable way to fabricate such building components and is desirable.

Standardization is also very helpful in this regard. There are a variety of building components which lend themselves to standardization. For instance, a typical house will have a pitched roof which extends from eave members along opposite sides through a pitched roof to a ridge top. Additionally, a building will normally have an interior baseboard. Most buildings, whether residential or commercial, will also have a need for conduits and passageways through which electrical, communications, and other wiring or cabling may be passed. Finally, most buildings will require a series of windows or other openings along exterior walls. Accordingly, it is helpful to be able to develop standardized apparatus which may be appropriate to each of these purposes.

Prefabricated, or other forms of standardized or hasty structures, require roofs just like any other. Roofs are complicated portions of the building, typically requiring substructures such as ridge beams, trusses, eaves, and roof framing beams to support the roof surface against dead loads, wind loads or other forces exerted upon the structure. The pitch of a roof dictates many specific requirements of construction and also may provide important building advantages, as will be discussed in greater detail later. In the construction of such structures, it would be helpful to be able to adjust the pitch of the roof as required for a given construction situation.

U.S. Pat. No. 5,454,204, issued to Jordal, on Oct. 3, 1995, teaches a window frame which can be manufactured through an extrusion process. The window frame taught by Jordal is adapted to secure a window within a "U" frame enveloping the window components. Jordal does not, however, teach a means and apparatus for securing the window frame itself to a building comprising structural panels. The point of Jordal is in the use of thermal breaks.

What is not provided in the prior art is a simple frame apparatus which is adapted to secure a window or door frame to a building comprising structural panels. It would be useful if such a frame-mounting apparatus was also adapted with means of providing other accessories, such as a storm shutter or decorative accessories for the door or window.

U.S. Pat. No. 5,423,157, entitled "Longitudinally Assembled Roof Structure and Method For Making Same", issued to Watanabe, et al, on Jun. 13, 1995, in fact, teaches a roof which is manufactured of longitudinally aligned roof panels. Generally, Watanabe teaches roof panels which comprise interlocking sections so that such panels assemble to one another as they rise from the eaves to the roof-ridge. It can be seen that it would be both difficult and compromise the integrity of the roof panels if it were necessary to cut or sever a given roof panel. This is because it would interrupt the structural integrity of the roof panel as well as the fact that a significant coupling member would be lost by cutting off one of the sides.

Similarly, U.S. Pat. No. 4,729,202, issued to Furland, on Mar. 8, 1988, teaches another roof structure comprising pre-cut roof panels which are longitudinally disposed from eaves to roof-ridge. In the case of Furland, certain fasteners are taught. As with Watanabe, Furland deals with the means of interlocking the longitudinally disposed roof panels to one another.

U.S. Pat. No. 4,327,532, issued to Matthews, on May 4, 1982, teaches an adjustable-eave apparatus for building curtain-wall skylights and greenhouses, and other small structures, made of glass panels retained by aluminum tubes. Matthews comprises a hinged-type apparatus which would affix to each individual vertical aluminum tube so that a glass and aluminum wall could be made of adjustable pitch by aligning a series aluminum tubes with glass panels. Accordingly, the placement of each hinge would be critical. Additionally, the hinge would receive the entire stress of the weight of the sloped glass and aluminum wall. Matthews does not teach an overhanging eave.

What is not provided in the prior art is an adjustable eave apparatus which is suitable for use in larger and more permanent-type structures, such as houses made of interlocking structural panels. An adjustable eave for such a structure should include an overhang and should be capable of bearing the weight of a series of roof panels consistent with the weight of the roof for a dwelling which could withstand the live and deadloads exerted by wind force and other elements.

U.S. Pat. No. 4,075,811, issued to Keith, on Nov. 11, 1976, teaches both a roof panel that is lightweight and structurally strong and also a means of fastening such a roof panel together with nut-and-bolt-type fasteners which are tightened between pairs of structural panels through a protruding-accessory design to hold the frames of the two panels in close proximity with each other and then closed with a cover. The apparatus taught by Keith can easily be seen to interrupt the continuity of the surface of one or the other side of each pair of structural panels.

U.S. Pat. No. 4,004,373, issued to Eschbach, et al, on Jan. 25, 1977, teaches extrusions for partitions, walls, and enclosures which provide a general "U" frame. Included within the Eschbach patent are a variety of clip-on type connections, which include enclosed covers, which are useful in clamping and assembling such structural component panels of a temporary nature, such as the shell of a vehicle. The components of Eschbach are generally capable of manufacture with the extrusion process, but generally do not teach a means and apparatus of securely anchoring a more permanent type building, such as a house, to the foundation nor accommodating it with means of delivering conduit for electricity, communications lines, or other utilities nor for providing for the assembly of roof panels with an adjustable pitch feature, nor for the attachment of windows or doors to a structural panel.

U.S. Pat. No. 4,196,555, issued to Henges, on Apr. 8, 1980, teaches another means of linking structural panels which are of a solid-core type. Such includes interlocking frame members. In particular, Henges teaches a corner structure and a means and apparatus of pivoting or providing angled relationships between such structural panels.

The apparatus taught by Henges does not provide for any decorative aspect, nor for the area near the foundation of a wall through which conduit for electrical and communications lines may be passed, nor for providing for the assembly of roof panels with an adjustable pitch feature, nor for the attachment of window or doors to a structural panel.

What is not provided in the prior art is an apparatus for serving as the baseboard for an interior wall for a foundational cover for an exterior wall for a permanent building 5 manufactured of interlocking structural panels. It would also be helpful to have such a baseboard or foundational cover which can be removed or clipped into place in order to install, remove, or service electrical or communications lines and to conceal and protect such lines from sight or from the elements.

What is not provided in the prior art is an adjustable roof-ridge connector which is uniquely adapted to receive roof structural panels. What is not provided in the prior art is an adjustable eave connector which is uniquely adapted to secure a structural roof panel to an exterior vertical wall panel. It is desirable to utilize a connection member that can be adjusted to accommodate the various pitches specified for different building types or to achieve a desired architectural look. It would also be useful to find such an apparatus which could be manufactured through an extrusion process.

SUMMARY OF THE INVENTION

U.S. Pat. No. 5,373,678, issued to Hesser, on Dec. 20, 1994, teaches a structural wall apparatus. Incorporated within Hesser's structural wall apparatus are building panels which comprise an outer and inner metal skin spaced by an intermediate insulating core of foamed polymer. Each such panel is adapted to have at least one interlocking edge with a metal line tongue in a metal line groove adapted to facilitate interconnection of panels as they are longitudinally interconnected. The panels taught by Hesser also comprise a reinforcing member with a strengthening beam on the other side of the metal line groove. Fasteners may be passed through various portions of the interconnecting grooves and beams in order to facilitate the connection.

While the mechanism taught by Hesser enables adjacent structural panels to interconnect, it does not teach a means of framing the structural panels so as to specifically accommodate certain portions of a building structure, such as the roof, the eaves, the foundational frame members, and the frames for doors and windows.

Such structural panels can be easily fabricated in mass quantities. With appropriate interconnecting members, they can be used for rapid erection of strong and reliable buildings. One of the advantages of such structural panels is in the standardization of the sizes and interconnecting members which not only make them easy to work with but also easy and quick to assemble and train construction workers for accomplishing even what would ordinarily be complicated tasks. Such standardization also facilitates the ability to standardize certain building accessories.

The present invention has solved the problem of providing a means of fastening window frames and doors to buildings of structural panels by providing a uniquely adapted "U" channel apparatus which can fit over either the tops or sides of such structural panels and is adapted to receive a window or door. Such is suitable for manufacture with the extrusion process as it is of uniform cross-section throughout its entire length. The unique frame member taught herein further comprises a channel through which a storm shutter or decorative fixtures may be securely mounted about a window or door.

It is an object of the present invention to provide a means of securing window and doors to a structural panel-type building.

It is a further object of the present invention to provide such a frame-mounting apparatus which may be manufactured through the extrusion process.

It is a further object of the present invention to provide such an extruded frame mounting apparatus which will further accommodate the secure positioning of storm shutters or decorative fixtures about a door or window.

It is well known that roofs are typically made with a pitch. The pitch serves multiple purposes. One purpose is to prevent the accumulation of rainwater or snow or other foreign objects on the roof in order to prevent corrosion or to prevent foreign articles from resting out of sight on the roof. Other purposes may include aesthetics or ventilation considerations. The pitch of the roof may be anywhere from a gradual or shallow angle to a steep or a sharp angle.

The present invention has solved the problem of facilitating the construction of roofs with different pitches by devising an apparatus which can be adjusted to facilitate the assembly and erection of roofs with a variety of different pitches. This is accomplished by means of an elongated eave apparatus which includes a lower roof panel receiving platform which is mounted to the top of the exterior vertical wall of the structure by means of an elongated hinge type mount. The roof platform allows an appropriate overhang. The hinge allows the lower roof platform to receive the lower end of a roof which may have a pitch at anywhere within an acceptable range of pitches.

It is, then, an object of the present invention to provide a roof framing structure for framing a roof comprising structural panels such as those taught in Hesser.

It is a further object of the present invention to teach such a roof framing apparatus which can be adjusted to accommodate roofs of different pitch.

It is a further object of the present invention to provide a eave connecting mechanism which will work with a reasonable range of roof pitches as may be required to accommodate specific buildings.

It is a further object of the present invention to provide such an eave connecting apparatus which may be manufactured through an extrusion process.

It is a further object that the connector enables the construction of free standing rigid structures that do not need an elaborate and expensive truss system to support the roof.

It is a further object of the invention to enable the connection of the two sloping roof halves with a thru-bolt connection.

It is a further object of the invention that the eave hinge can be thermally broken.

It is a further object of the invention to provide a structural connection at the panel ends which effectively handles the transfer of positive and negative windloads transferred from the structured roof panel to the exterior wall panel and to the foundation.

The present invention has solved the problem of securing a building constructed with structural panels to the foundation by adapting a "U" channel connecting member with a cover member for concealing electrical, communications, or other conduit or lines which may be necessary to install through a building near the floor or foundation. The assembly taught herein is easily removed or installed with a snap lock configuration.

The apparatus may be manufactured with an anchoring member which is built into the "U" frame or it may comprise a separate member for fastening onto the side of a "U" frame or vertical wall panel.

It is an object of the present invention to provide a foundational anchor which transfers the positive and negative wind loads to the building foundation.

It is, then, a further object of the present invention to provide a foundational connecting member which improves the resistance of structural panel frame to both positive and negative wind load.

It is a further object of the present invention to provide a baseboard or foundational anchor cover through which electrical or communications or other conduit may be passed.

it is a further object of the invention that the foundational connector can be thermally broken.

It is a further object of the present invention to provide such a foundational cover or baseboard shroud which can be manufactured through the extrusion process.

It is a further object of the present invention to provide such an extruded foundational cover or baseboard cover which may simply be installed or removed for servicing.

Perhaps the most critical portion of any roof structure is the ridge top. At the ridge top, the two sloping halves come together. It is important that the two converging halves fit precisely together so that water intrusion or air filtration will not occur. The ridge connection must be structurally strong and the beam between the halves must cause two sloping members to fit together.

It should be noted that buildings constructed with structural panels such as those taught by Hesser are designed with a variety of pitches generally ranging from a 3" rise in 12" of run to a 12" rise in 12", of run. It is desirable, therefore, to have available a roof ridge member that can accommodate a variety of building designs.

The Inventor has solved this problem by providing a roof ridge member with frame receiving members for receiving the edges of the structural panel members taught by Hesser and further comprise an elongated rotating sleeve member for providing a stable and reliable ridge which can adjust between a range of pitches sufficient to permit any reasonable roof pitch.

It is, then, an object of the present invention to provide a structural beam between the sloped halves of a structural panel roof that will withstand the forces of wind and other elements.

It is a further object that the ridge beam can be thermally broken.

It is, then, an object of the present invention to provide a roof framing structure for framing a roof comprising structural panels such as those taught in Hesser.

It is a further object of the present invention to teach such a roof framing apparatus which can accommodate roofs of different pitch.

It is a further object of the present invention to provide a roof ridge mechanism which will work with a reasonable range of roof pitches as may be required to accommodate specific buildings.

It is a further object of the present invention to provide such a roof ridge apparatus which may be manufactured through an extrusion process.

It is a further object that the beam enables the construction of free standing rigid structures that do not need an elaborate and expensive truss system to support the roof.

It is a further object of the invention to enable the connection of the two sloping roof halves with a thru-bolt connection.

It is a further object of the invention to provide a structural connection at the panel ends which efficiently handles and manages the transfer of positive and negative windloads through the aluminum "U" channel to the adjacent panels and to the foundation.

It is a further object of the invention to improve the current method of framing roof panels in order to better withstand the positive or negative windloads which may be placed upon them.

Other features and advantages of the present invention will be apparent from the following description in which the preferred embodiments have been set forth in conjunction with the accompanying drawings.

BRIEF DESCRIPTION OF THE DRAWINGS

In describing the preferred embodiments of the invention reference will be made to the series of figures and drawings briefly described below.

FIGS. 1' and 1" are enlarged cross-sectional views of regions in FIG. 1.

FIG. 3*a* depicts an exterior view of a window mounted within such structural panels with the "U" channel connector depicted in 2*a*.

FIG. 2*b* depicts the eave hinge wall capping frame member.

FIG. 3*b* depicts the eave hinge roof panel receiving member.

FIG. 2*c* depicts the cross section of the exterior wall anchoring member for the foundational cover member which is made integral with the foundational connector.

FIG. 3*c* depicts the cross-section of the foundational cover member according to the present invention.

FIG. 5*c* depicts an anchor member for the foundational cover member which may be directly fastened to a building stud.

FIG. 6*c* depicts a baseboard cover as attached to a wall.

Figure 1:
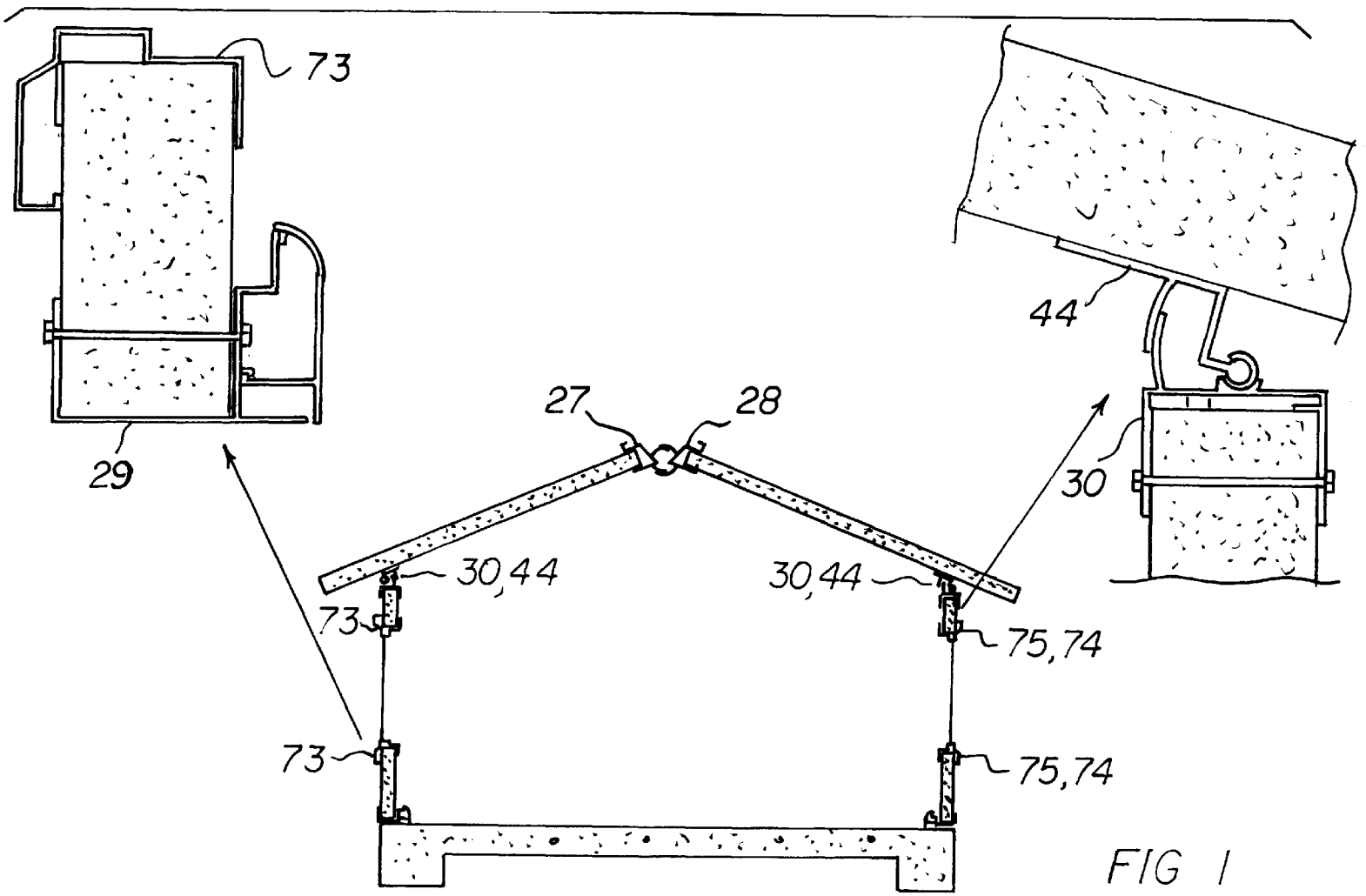
FIG. 1 is a perspective view of the preferred embodiment system for constructing buildings or homes from structural panels and structural connecting members.

While certain drawings have been provided in order to teach the principles and operation of the present invention, it should be understood that, in the detailed description which follows, reference may be made to components or apparatus which are not included in the drawings. Such components and apparatus should be considered as part of the description, even if not included in such a drawing. Likewise, the drawings may include an element, structure, or mechanism which is not described in the textual description of the invention which follows. The invention and description should also be understood to include such a mechanism, component, or element which is depicted in the drawing but not specifically described.

DETAILED DESCRIPTION OF THE PREFERRED EMBODIMENT

Reference will now be made in detail to the present preferred embodiment of the invention, an example of which is illustrated in the accompanying drawings. While the invention will be described in connection with a preferred embodiment, it will be understood that it is not intended to limit the invention to that embodiment. On the contrary, it is intended to cover all alternatives, modifications, and equivalents as may be included within the spirit and scope of the invention defined in the appended claims.

While the following description will seek to improve understanding of the invention by describing the various components and elements, it should be considered that certain apparatus may be sufficiently and adequately explained by the accompanying drawings, which are fully incorporated herein, and not require further description. All such apparatus should be considered as part of the specification of the invention for all purposes.

FIG. 1 depicts the preferred embodiment of the structural connector system for the assembly of structural panel buildings. This depiction shows all of the component parts of the system utilized together. FIGS. 1*a* through 5*d* are detailed depictions of the components of the system. These components are explained in the paragraphs following the FIGS. 1 and 2 descriptions.

In its broadest context the structural connector system for the assembly of structural panel buildings comprises a plurality of connector components for coupling structural panels.

A plurality of panels are fabricated of a rigid elastomeric material with thermal insulating capabilities. Each of the panels is clad on opposite parallel faces with heavy gauge metal. The panels include roof panels with a periphery therearound and are angled with respect to each other to form a linear ridge at the top. The panels also include vertically disposed wall panels of a house with upper edges thereof positioned adjacent to the periphery of the roof panels. The wall panels also have lower edges coupled with respect to a fixed base.

A pair of adjustable roof ridge structural connectors each have generally U-shaped ends with flat faces receiving adjacent edges of the roof panels and with radial adjustable sleeve components positioned therebetween.

An adjustable eave structural connector is positioned between the upper edges of the wall panels and the roof panels adjacent to the periphery. The eave structural connectors have a generally U-shaped side with flat faces receiving the wall panels adjacent their upper edges. The eave structural connectors have a flat surface coupled to the roof panel with an adjustable rotational axle component therebetween.

Base structural connectors 29 have generally U-shaped sides with flat faces receiving opposed exterior faces of wall panels adjacent to their lower edges. The base structural connectors include remote components fixably positionable with respect to the base.

Wall opening structural connectors 73 for windows and doors are provided. The wall opening structural connectors are formed with a generally U-shaped side with flat faces receiving opposed exterior faces of wall panels at the receiving wall window and door openings. The wall openings structural connectors have second ends for receiving doors and windows, respectively.

Figure 2:
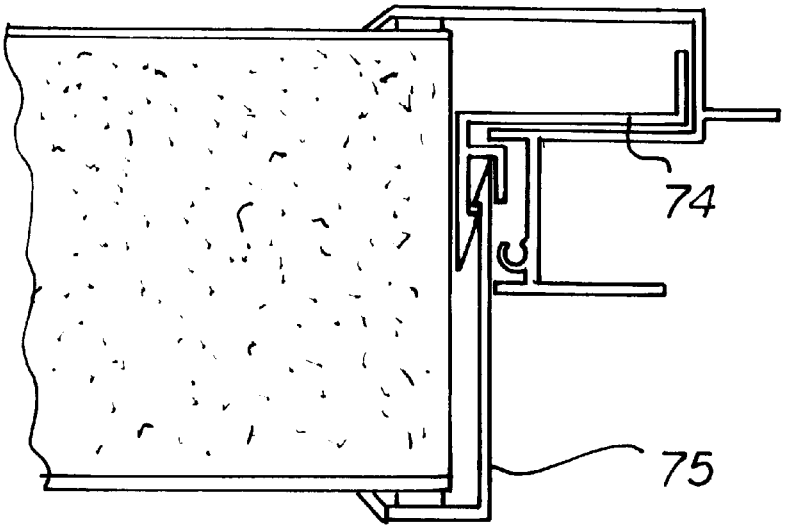
FIG. 2 is a cross-sectional view of the Snap-Lock design window frame.

A snap-lock design window anchoring apparatus is shown in FIG. 2. Said anchoring apparatus includes an anchor clip 74 concealed within the window jamb and an interior snap-on anchorial frame 75 which snap locks onto the window jamb to form a "U" channel configuration which clamps the window jamb firmly to the structural panel. The snap-lock apparatus can be used with any window to accomplish the attachment of the window to the structural panels. This eliminates the need for fasteners or other mechanical means commonly used to anchor windows to buildings. The anchor clip and anchoring frame have interlocking heads to permit coupling of these members. The anchor clip is couplable to a window jamb thereby permitting the secure attachment of a window jam to a structural panel.

More specifically, the window jamb has an upper region and a lower region. The upper region includes long and short horizontal segments with inboard and outboard sides. The outboard sides are connected by a vertical segment. The inboard side of the long segment is couplable to a structural panel. The lower region is formed in a generally L-shaped orientation and depends from the short horizontal segment.

The anchor clip is formed in an L-shaped configuration with a short section couplable to a window jamb and a long section having a triangular head. The anchor clip has an upper vertical piece, a lower vertical piece and a horizontal piece connected therebetween. The lower vertical piece has a triangular head and a retaining leg extending therefrom. In an operative orientation the upper vertical piece is coupled to the vertical segment of the window jamb with a rivet and the heads of the clips are positioned in an interlocking orientation adjacent to the retaining leg. This orientation permits secure coupling of the interior snap on anchoring frame to the window jamb.

Figure 1A:
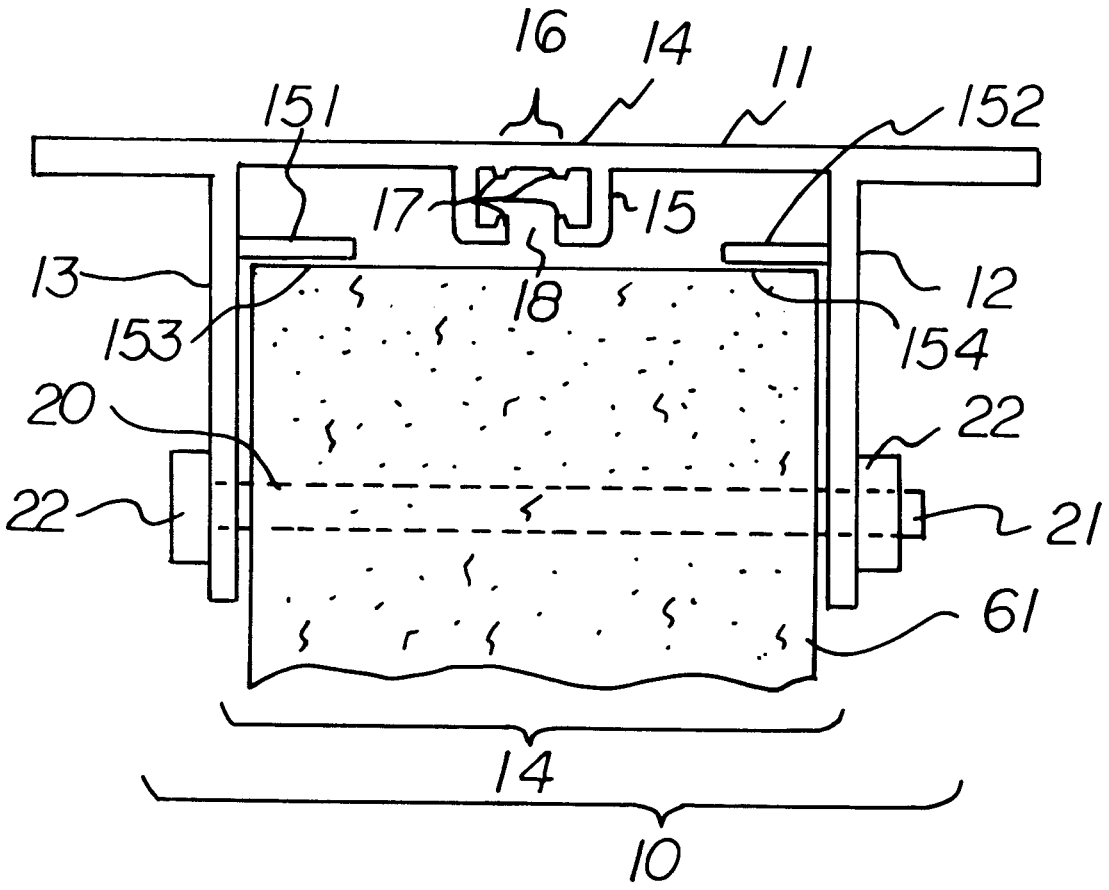
FIG. 1*a* is a cross sectional view of a standard "U" channel for receiving structural panels.

As depicted in FIG. 1*a,* a fundamental apparatus for receiving such structural panels is a three-sided frame member which generally describes a "U" or "C" (10). Such would comprise three connected flat sides (11, 12, 13) with two parallel side members (13, 12) which are joined by a perpendicular base member (11). The spacing (14) between the two side members (12, 13) would be such as to snugly receive a structural panel, such as the one taught by Hesser.

Such a general frame structure (10) may easily be manufactured with an extrusion process since all of the surfaces are both straight and uniform. In this manner such a frame member may be fabricated of any desired length and may be cut to any length. Generally speaking, in the extrusion process, an elongated apparatus with a continuous cross section can be manufactured by heating a desired metal (such as an aluminum alloy) and forcing the metal through a cross-sectional die. As the molten aluminum assumes the cross-sectional shape of the form and passes through, it begins to cool and harden. This results in an elongated metallic structure with the desired cross section and of any desired length. This is an efficient and cost-effective means of manufacturing a variety of objects, including connecting members, which also produces a consistent structure. Such extrusion method is mentioned by way of general familiarization and is not claimed, in and of itself, as part of this invention. However, the potential for the utilization of extrusion in the practice of this invention is an important consideration when considering its advantages and utility.

While not necessary, as further depicted in FIG. 1*a,* it can be seen that such members may be constructed with a thermal break (15) which reduces the thermal transmission of heat or cold from the outer connector surface to the inner connector surface. This feature is particularly useful for buildings erected in cold climates. The thermal (refer to thermal break U.S. Pat. No. 3,204,324 to "Wilson") break comprises a cavity section (15) with ribbed members (17). The cavity section (15) may be filled with an adhesive binding material (18), such as a liquid urethane, while a portion (16) of the outer cavity (19) can be cut away so as to break the normal continuity in the aluminum base member (10). The structural integrity of the base member (10) through this region is now provided by the binding material (18) and a reduction in thermal transmission is achieved while maintaining the structural integrity of the "U" shaped channel (10) or the structural panel (80) which may be housed within. Such a thermal break (15) may be positioned along the length of any structural panel wall section being contained by the frame section to maintain continuity in the thermally broken and insulated building system.

It should be noted that such thermal breaks can be easily incorporated into an extrusion. It should also be noted that thermal breaks are already well known in the construction art and are not the subject of the present invention. Certain further modifications, innovations, and adaptations of frame members made with thermal breaks, however, are taught herein as means of accomplishing the objectives of the present invention. Such modifications, innovations, and adaptations are the subject of the claims of the present invention.

When a thermal break (15) is used, there is an interruption in the continuity of the base member (11). Depending upon the configuration of a given structural panel (61), this may not pose a problem. It is necessary for the structural panel (61) to rest flat and straight within the frame member (10) and the thermal break may cause a disruption of the structural panel edge.

Additionally, such a connecting member (10) is amenable to the placement of fastening screws or bolts (21) at any point along its length. Channels (22) may be drilled which pass through the connecting member (10), as well as the encased or framed structural panel (20) which may receive a fastening member (21) to hold the structural panel (20) stable within or between the side panels (12, 13) of the frame member (10).

Figure 2A:
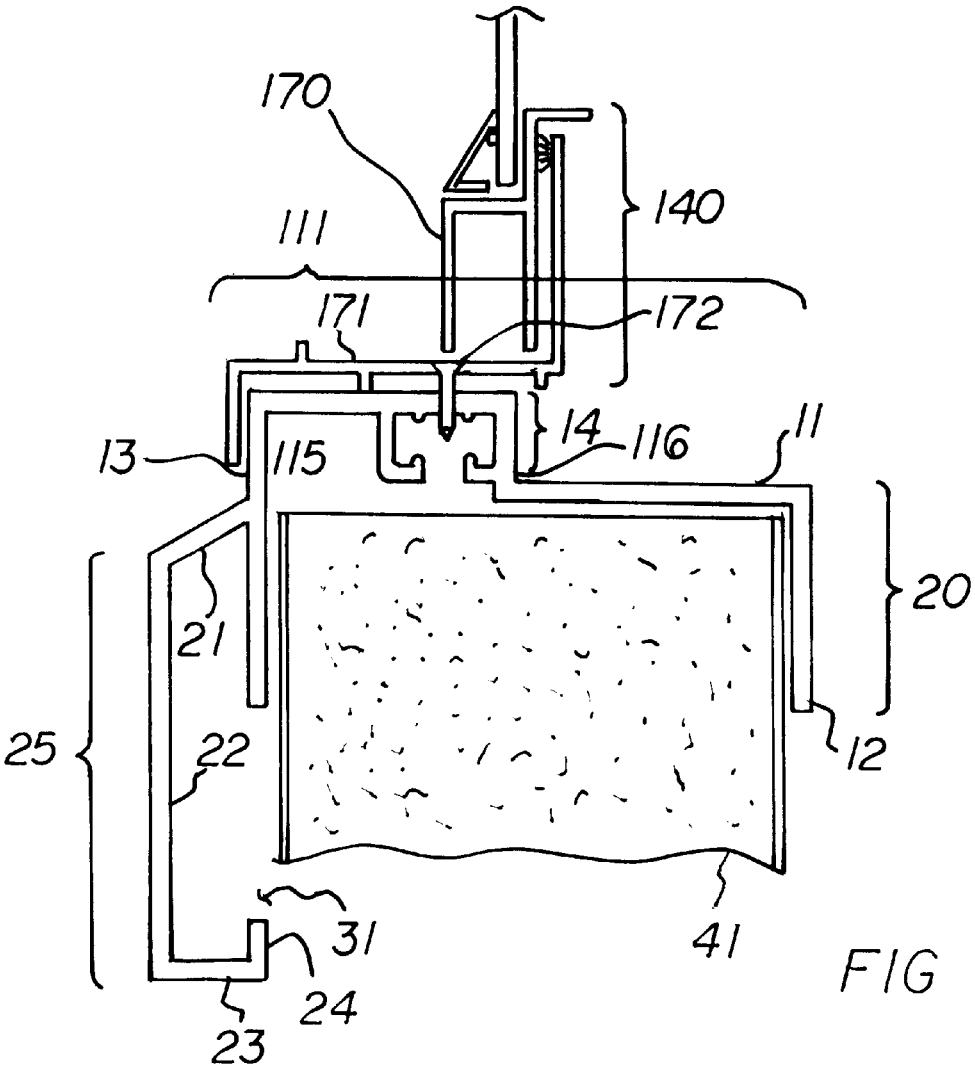
FIG. 2*a* depicts a cross section of a "U" channel which has been modified and adapted to receive a window frame.

As may be seen by reference to FIG. 2*a,* this standard "U" type structural panel connector may be modified in order to accommodate the task of anchoring a door or window (140) to a building comprising structural panels such as that taught in Hesser or other forms of structural panels. Such a structural panel anchor is of simplified construction and is easily tailored to work with extruded materials or to be manufactured with the extrusion process.

Making reference first to FIG. 2*a,* it can be seen that the base or interior portion (11) of a "U" frame (20) could be made with an offset portion (14). For the purpose of mounting windows and doors this "U" member would have an interior side (12) and an exterior side (13). However, the joining member (111) between the interior side (112) and exterior side (113) would further comprise an offset frame-receiving flange (116), which may (but need not) be used to position a thermal break (115).

Making further reference to FIG. 2*a,* it can be seen that a mounting side (171) of a window frame (170) can be fastened to the offset flange (116) by means of a fastening screw (172). It can also be seen that on the exterior side member (13) could be adapted a channeling member (25). Such channeling member (25) could comprise a generally four sided portion with straight sides (21, 22, 23, 24) and one side (25) further comprising a slotted opening (25). This slotted opening (25) would be of an appropriate dimension to receive an edge (31) protruding from the exterior surface (17) of one of the structural panels (41).

The channel defined by these sides (21, 22, 23 24) may be used to slidably receive a mount for an accessory, such as a storm shutter or a mantle for a window box of flowers. (Please see FIG. 3*a*).

Depending on whether this frame anchor member (20) was to be used for a door or a window the various surfaces on the base member and side members could be used in a variety of ways. Screw-type fasteners (151) could be driven through the window or door frame either portion of the offset or the space enclosed within the frame member adjacent to the thermal break could be used to receive an edge or protrusion upon the end of the structural panel to provide further anchoring or fastening.

Making reference now to FIG. 4*a,* it can be seen that opposite offset portions (141, 142) could be used to mount a door (180) as follows. A butt hinge (181) could be positioned on a frame corner about which a door could pivot from an open position (not depicted) to a closed position where the non-hinged door side (182) could rest against the opposite offset portion (142).

While the apparatus herein has been taught for use with a structural panel of the type of Hesser, it should be noted that such could be used with a variety of structural components, including solid-core structural panels, structural beams (such as four by four wood members commonly used for major frame portions of wooden structures), composite panels; and a variety of others. These frame members have particularly been adapted for use with the Hesser-type panels because a need existed to provide more secure and versatile framing of structural panels which included metal skins and foam interiors. The panels taught herein are of a thermal break design. It should also be noted that for thinner structural panel-type components a thermal break may not be needed. In such a case a cavity could be provided simply to accommodate a fastener or the cavity could be disposed of altogether.

Thermal breaks should not be considered a necessary part of the invention as taught herein, but have been included in the descriptions and drawings in order to demonstrate that the principles of the present invention can work with structural panel buildings which may be designed with a thermal break.

Generally speaking, these connectors may be adapted to accept panel thicknesses ranging from about two inches to ten inches. When manufactured of aluminum through the extrusion process, they may be manufactured from aluminum of high-strength alloys commonly known as 6005, 6061, or 6063.

The drawings and descriptions further have depicted some rather specific geometrical shapes for the adaptations which receive the window frame, electric conduit cover, or other features. It can readily be seen that these specific geometrical shapes are not critical to the invention, but what is critical to the invention is that some receiving channel or area be provided to receive the desired building component, whether it be a conduit or an edge for attaching a door or a window or a structural panel.

Regarding FIG. 1, note that when a thermal break (15) is used there is an interruption in the continuity of the base member (11). Depending upon the configuration of a given structural panel (61), this may not pose a problem. It is necessary for the structural panel (61) to rest flat and straight within the connecting member (10) and the thermal break may cause a disruption of the structural panel bottom edge. There may also be situations wherein it is necessary to position a structural panel (10) more precisely within the connector (10) and the thermal break cavity apart from member (11). In these cases one or two positioning platforms could be positioned and inwardly disposed from either side member (12, 13) of the frame (10). Such positioning platforms would have planar surfaces' (153, 154) which were perpendicular from the side members (12, 13). If two positioning platforms were to be used, they should line up within the same plane. Such positioning platforms could easily be included in an extrusion form.

Additionally, such a connecting member (10) is amenable to the placement of fastening screws or bolts (21) at any point along its length. Channels (22) may be drilled which pass through the frame member (10), as well as the encased or framed structural panel (20) which may receive a fastening member (21) to hold the structural panel (20) stable within or between the side panels (12, 13) of the frame member (10).

Making reference now to Figure b, the eave hinge capping member (30) for the upright wall is depicted. It can be seen that the capping member (30) is basically a "U" channel which may, but need not have, an offset thermal break (31) and which further may include one or two interior protrusions (32, 33) for enabling the capping member (30) to stably rest upon the top of a structural panel (50) without being compromised or disturbed by the thermal break (31).

Still making reference to Figure b it can be seen that upon the exterior top (60) of the capping member (30) is provided a rotational sleeve (34) and an arched flange (35) which has one surface (36) of an appropriate arc and length to congruently slide along the surface (46) of the roof receiving flange (45). The rotational sleeve further comprises an elongated slot opening (38), which is large enough to accommodate an offset portion as will be described later.

Making reference now to FIG. 3*b* the construction of the roof receiving member will be more thoroughly described. An elongated rotational axle (41) is at the end of a shank which may further be connected in an offset manner by an offset connector (78) to a roof receiving surface (43). A thermal break coupling (44) may, but need not, be provided for reducing thermal transmission. A flange (45) with at least one circularly arched surface (46) is adapted on the lower side of the roof receiving surface (44) for the purpose of providing rotational stability as will be described later.

Figure 4D:
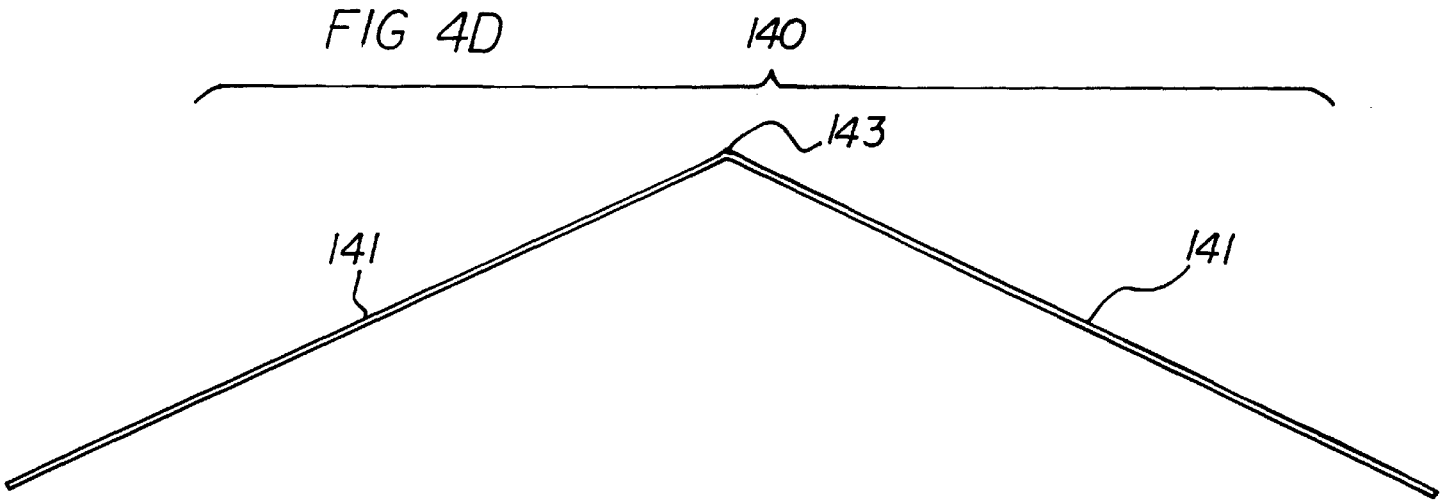
FIG. 4*d* depicts the cross-section of a roof ridge cover member.
Figure 4A:
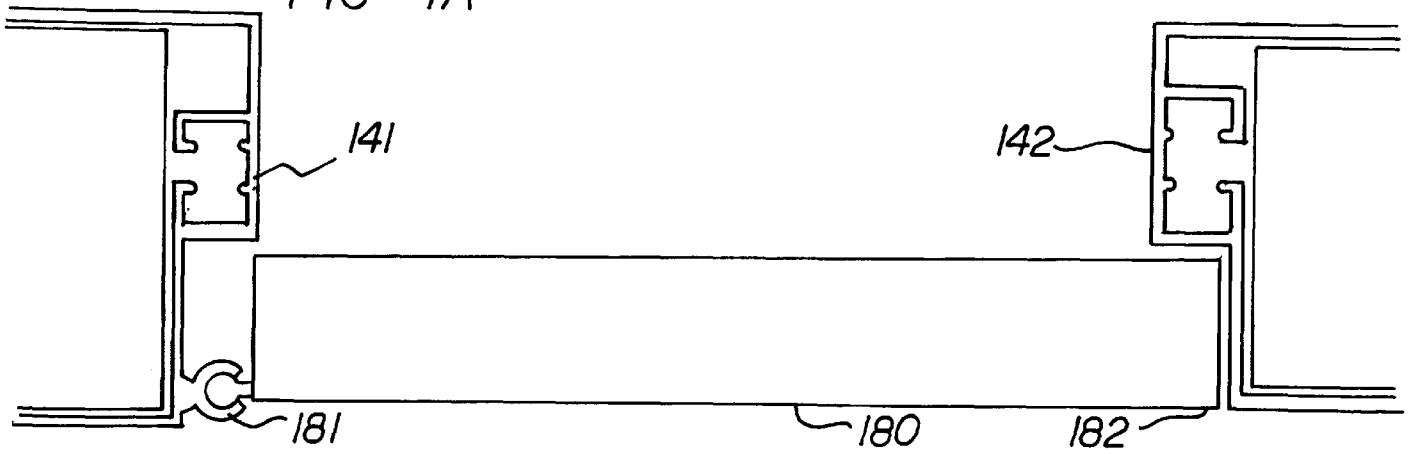
FIG. 4*a* depicts a cross-sectional view of a door positioned and framed by the "U" channel connector depicted in 2*a*.
Figure 4B:
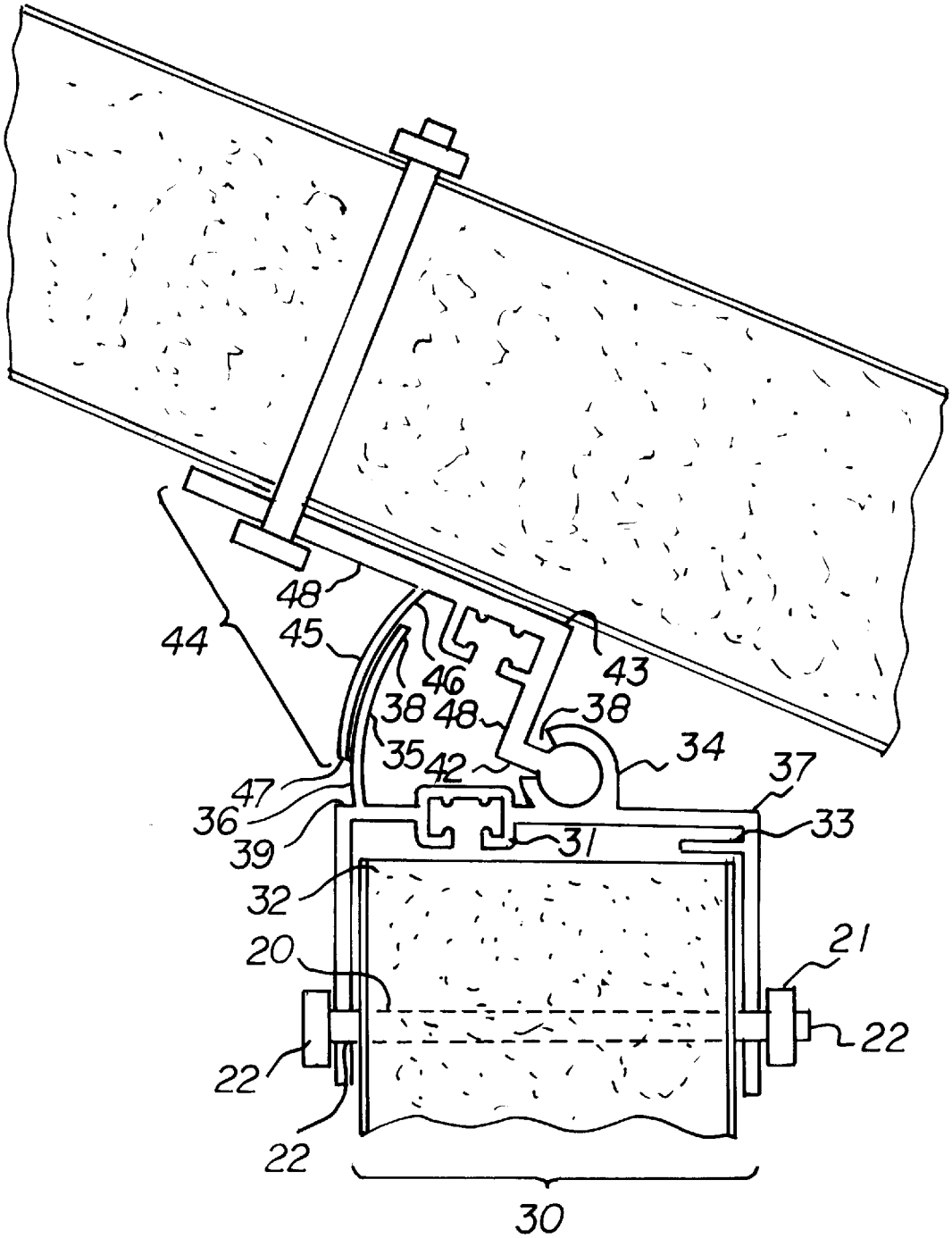
FIG. 4*b* depicts the eave connection apparatus as assembled.

Making reference now to FIG. 4*b* it can be seen how the pieces fit together. The length of the elongated rotational axle (41) may be slid through the length of the rotational sleeve (34). The elongated rotational axle (41) should be of a size to snugly fit within the rotational sleeve (34) but not so tight as to prevent free rotation throughout the permitted range of rotation, which can be seen to be defined by the rotation of the shank (42) through the sleeve slotted opening (37).

The permitted range of rotation can be seen to be that range which will permit an overhanging roof panel (70) from making contact with the outer corner (37) of the eave hinge capping member (30) as the steepest pitch allowed and then rotating to a point where the ends (38, 47) of the two flange members (34,45) make contact with either or both the lower portion (48) of the roof receiving surface (40) or the exterior top (39) of the capping member (30), respectively.

To further complement the stability and operation of the apparatus the various movable portions may be precision engineered to precisely define this range. For instance, each of the arched flange members (35, 45) could be cut to an arc and length so that the ends (38, 47) of the flange members (35, 45) will touch the respective surfaces (48,39) of the other cooperating member (30, 40) precisely at the point of the smallest pitch angle and that an overhanging roof panel (70) sitting on top of the roof receiving surface (40) will approach the outer corner (37) of the capping frame member (30) at or near the steepest allowable roof pitch. In a similar manner, the shank (42) of the elongated rotational axle (41) may also be adapted or configured to make contact with the upper (51) and lower (52) lips of the opening (53) of the rotational sleeve (34) at the same maximum and minimum roof pitch angles.

It should also be noted that the arched flange members (35, 45) are adapted with a locking means. In the preferred embodiment such locking means comprise a self threading screw positioned through a pilot hole drilled through the flanges. In alternate embodiments a bolt may be passed through a hole drilled in capping member flange (35) and a corresponding hole in the platform flange (45) in order to provide increased stability.

While the apparatus herein has been taught for use with a structural panel of the type of Hesser, it should be noted that such could be used with a variety of structural components, including solid-core structural panels, structural beams (such as four by four wood members commonly used for major frame portions of wooden structures), composite panels; and a variety of others. These frame members have particularly been adapted for use with the Hesser-type panels because a need existed to provide more secure and versatile framing of structural panels which included metal skins and foam interiors. The panels taught herein have thermal breaks. It should also be noted that for non-thermally broken systems a thermal break may not be needed. In such a case the thermal break cavity would not be filled and debridged or the cavity could be disposed of altogether.

Thermal breaks should not be considered a necessary part of the invention as taught herein, but have been included in the descriptions and drawings in order to demonstrate that the principles of the present invention can work with building systems which may require a thermal break.

It should be noted that the invention has been discussed with respect to structural panels of the type taught by Hesser. It should-be noted that the features and principles of the present invention could also be used or successfully practiced with a variety of other forms of structural panels. It is anticipated that any structural panel which would be used by this invention would be such as to permit the boring of a hole for the purpose of receiving bolt-type fasteners through the opposite sides of the variously configured "U" channel members. However, even that could be subject to substitution by other forms of adhesive or fastening members which could be passed through or affixed upon to bind the "U" channel to a desired structural panel.

As depicted in FIG. 2*c,* such a "U" channel member may be adapted on either the interior or exterior side with a base plate or baseboard anchor member (20) for receiving and passing electrical, communication or other conduit. As depicted in FIG. 2*c,* one of the side panels (12, 13) could be adapted with an offset portion (21) and a snap-in portion (22). The offset portion (21) is adapted with an elongated slot (23). The snap-in portion (22) is adapted with a slanted lower surface (24). The lower or base frame section (25) is extended beyond at least one of the upright sides (12, 13) with an extended length (26).

It can be seen how a cover member (30) (please see FIG. 3*c*) can be adapted to snugly and securely fit upon the anchor member (20) in order to provide an acceptable and decorative cover (31) for electrical, communications, or other conduit not depicted). Such cover (31) would have an upper portion (32) which ends in a generally flat top portion (33) which is adapted with a elongated and flat protrusion (34). This elongated and flat protrusion (34) is adapted to snugly fit within the elongated slot (23) on the offset portion (21) of the anchor member (20). From the generally flat-top portion (33) may extend a cover (31) which, as depicted in FIG. 4*c,* arcs around to a cover side (35) which may, but need not be, parallel to a side (27) of the anchor member (20) and generally perpendicular to the flat top portion (33) of the cover member (30).

While the drawing depicts an arcing cover member (30), it should be noted that the convergence between the flat top (33) and side (35) of the shroud member (30) could be achieved by having right-angle portions, an angled member from the top portion down to the desired point and/or other similar configurations. Such alternative configurations can easily be understood or conceptualized from this description and are not separately depicted in drawings.

From the cover side (35) extends an elongated snap-in leg (36) which is adapted to cooperate with the anchor member snap receiving portion (22) as follows. The cover member snap-in portion is adapted with an upper surface which matches the snap-in surface of the base-receiving member. The cover snap-in member (36) can then be pushed against the anchor snap receiving member (22). The cover elongated protrusion (37) upon which the snap-in member (36) is fixed may then give sufficiently with the stress of being pushed in to the anchor enabling the cover snap-in member (36) to pass over the slanted surface (24) of the anchor snap-in portion (22) until it passes it and snaps into place between the anchor member (22) and the snap-receiving member (22).

Figure 4C:
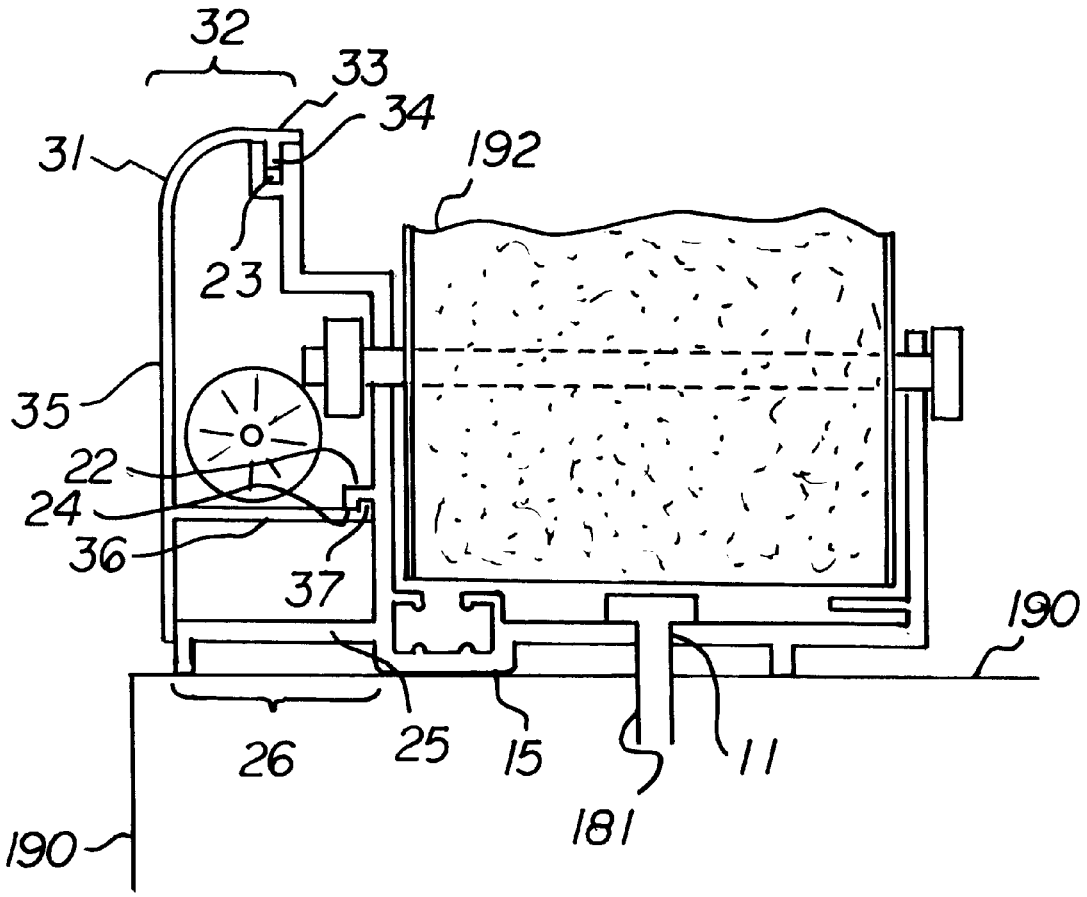
FIG. 4*c* depicts the anchor and cover members as interconnected.

The side (35) of the cover member (30) extends generally down to a point (38) at which it can match up with the elongated end (16) of the base member (11) or, if there is no elongated end to the base member (11), it can be cut or broken to an appropriate length to match up with a floor or other surface (not depicted) FIG. 4*c* depicts the apparatus as assembled with the cooperating parts in place.

Making reference to FIG. 5*c,* it can be seen that the anchor member for receiving the cover could be a separate piece bolted onto a building stud (170) rather than built into a structural panel connector as described in FIG. 2*c*. As a fastener (161) will normally be used to hold a structural panel into place, the same fastener (161) could be used to hold a cover receiving apparatus onto a desired stud member (170). In either case the cover member would function in the same way.

The basic structure of the cover-receiving member could be accomplished in a number of ways and with a variety of alternative structures which do not deviate from the basic components, which include an elongated slot and snap-receiving member on the base cover receiving member and an elongated edge and snap-in member on the cover member.

It should also be noted that the thermal break in this base anchor is not at the center of the base of the "U" channel. In order to ensure an appropriate leveling of the fastened structural panel, it can be seen that from the opposite of the "base plate" anchor a leg is providence upon which the inner edge of the structural panel may rest in order to be level with the opposite thermal break side.

The baseplate anchor depicted in FIG. 2*c* is suitable for use along the foundation of an exterior wall The structure depicted in FIG. 5*c* is more suitable for use on the baseboard of an interior wall. In either case, however, the general structure is the same and the function is the same, namely to provide a continuous and attractive surface which can be used to cover the desired electrical, communications, or other conduit. It should be noted that the lower portion of the base member of the exterior wall baseplate anchor may further be adapted with means of leveling it with the thermal break or providing a better fit along the outside of a foundation.

It is also possible to replace or substitute another fastening means for the snap-in members presently taught at the bottom of the cover. For instance, the lower end of the cover and the lower end of the baseplate anchor member could be adapted with some combination of cooperating slot and edge members to allow the cover to be slid into position along the lower foundational baseplate anchor. This would be somewhat less convenient, but would be more stable. Moreover, such a double slot combination could most likely be used only with exterior walls. It should be noted that the lower slot and edge could be reversed so that the edge could be positioned upon the lower portion of either the anchoring member or the lower interior portion of the cover member and cooperate with a slot positioned on the facing side of the other member.

Additionally, the baseplate anchor or cover members could have a lower protruding positioning edge of sufficient width to just hold the cover in place by gravity. Such an apparatus could be given additional stability by simply driving a long screw through the cover which may extend and be turned into the anchor member as well.

Making reference again to FIG. 4*c,* two important modifications of the apparatus should be discussed. First is that, when the baseplate connector member is being used as a true exterior wall anchor, one or more foundational anchor bolts (181) could be used in order to secure the baseplate connector and the wall to the building foundation (190). This would almost always be the case when the present invention is used on the ground floor of a structure and could also be used for upper floors, if desired. Additionally, the various forms of the baseplate connector cover apparatus taught here have included an upper pocket (192), which is created by positioning the upper slot (23) away from the structural panel (61). This pocket (192) may be used to receive drywall or other wall coverings as desired. It would, however, be possible to practice the present invention with no such pocket. In that case, the entire anchor cover would rest flush against the structural panel. This need not be depicted herein, but should be understood as an alternative which is in keeping within the spirit and scope of the present invention.

Figures 2D, 3D:
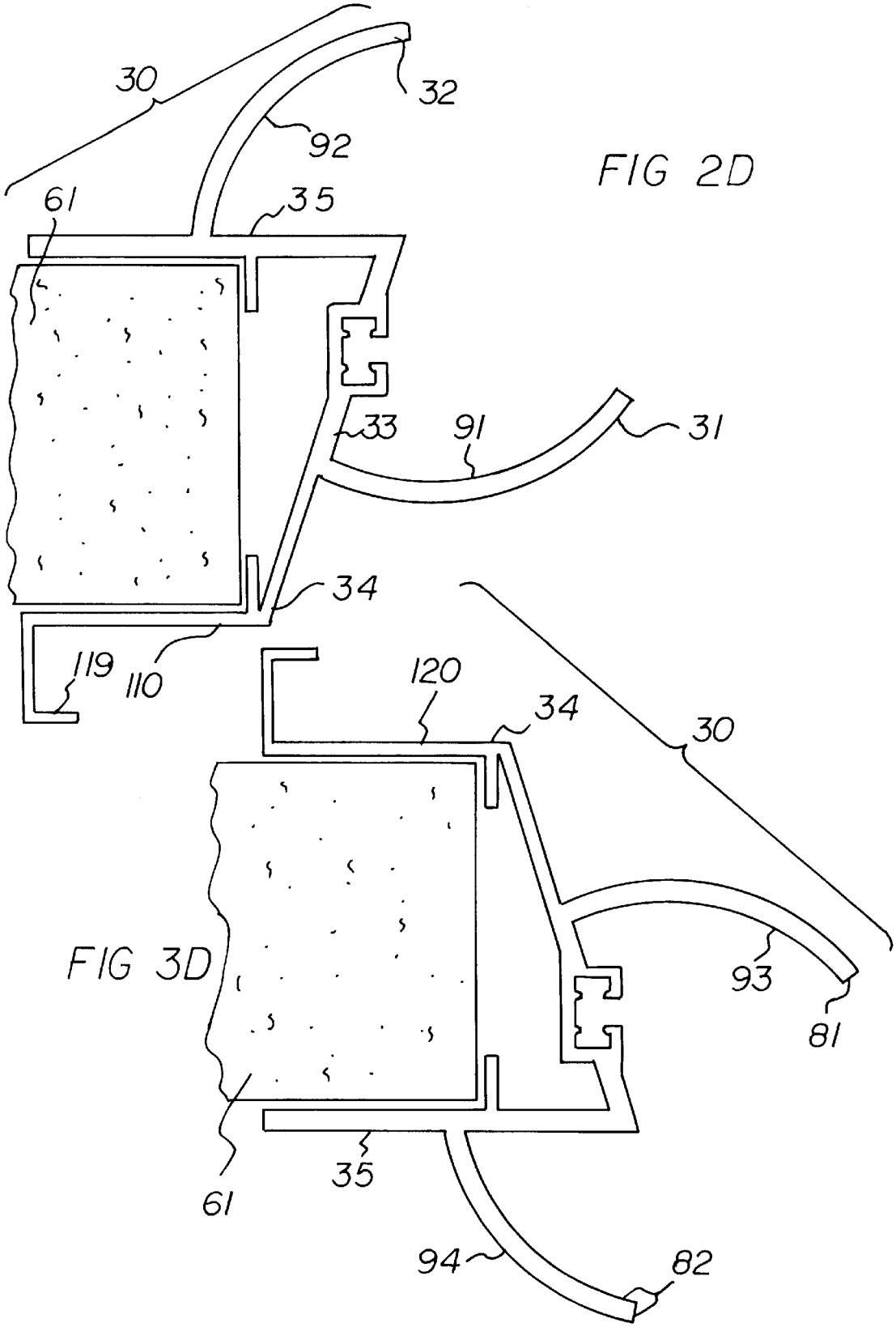
FIG. 2*d* depicts a cross-section of a roof ridge member according to the present invention with an outer rotational sleeve member.
FIG. 3*d* depicts a cross-section of a roof ridge member with an inner rotational sleeve member.

Making reference now to FIG. 2*d* it can be seen that the basic connector member structure has been substantially modified to form a first roof top connecting member (110) in order to receive the top edge of a structural roof panel (61) in a connector (30) which is further adapted with arched sleeves (31, 32) which arc out from the base portion (33) and lower side member (35) so as to have inner surfaces (91, 92) which geometrically define two portions of the same circle. Additionally, the base portion (33) of the connector member (30) is angled slightly from the upper side member (34) to the lower side member (35). The importance of this will be discussed later. The top of this connector side further comprises a fixture (119) for receiving a ridge beam cover.

Making reference now to FIG. 3*d* it can be seen that this same modified basic connector member structure has been substantially reproduced in order to form a second roof ridge connector member (120) in order to receive the top edge of a structural roof panel (61) in a frame (30) which is further adapted with inner arched sleeves (81, 82) which arc out from the base portion (33) and lower side member (35) so as to have outer surfaces (93, 94) which geometrically define two portions of the same circle. The circle defined by these sleeves (81, 82) is of a dimension to snugly fit and rotate within the circling sleeves (31, 32) of the first roof ridge connector (110) half. Additionally, the base portion (33) of the connector member (30) is angled slightly from the upper side member (34) to the lower side member (35). The importance of this will be discussed later. The top of this frame side further comprises a fixture (129) for receiving a ridge beam cover.

FIG. 4*d* depicts the cross-section of a ridge beam cover (140). Such ridge beam cover (140) comprises two sides (141, 141) which are joined at an apex (143) in order to form a triangle shape. The ends are further adapted with fixtures which are to be fastened and housed within receiving members on each of the first and second roof ridge beam halves (119, 129).

Figure 5B:
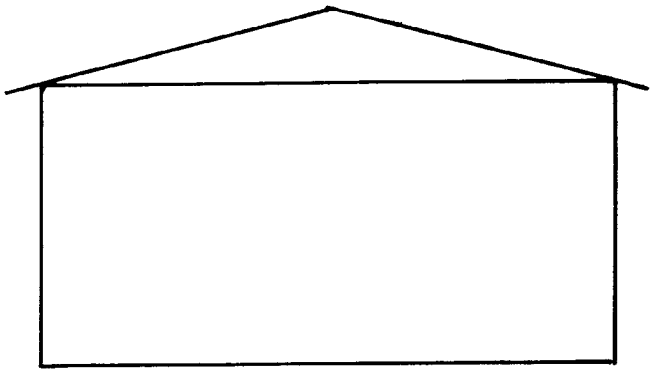
Figure 5D:
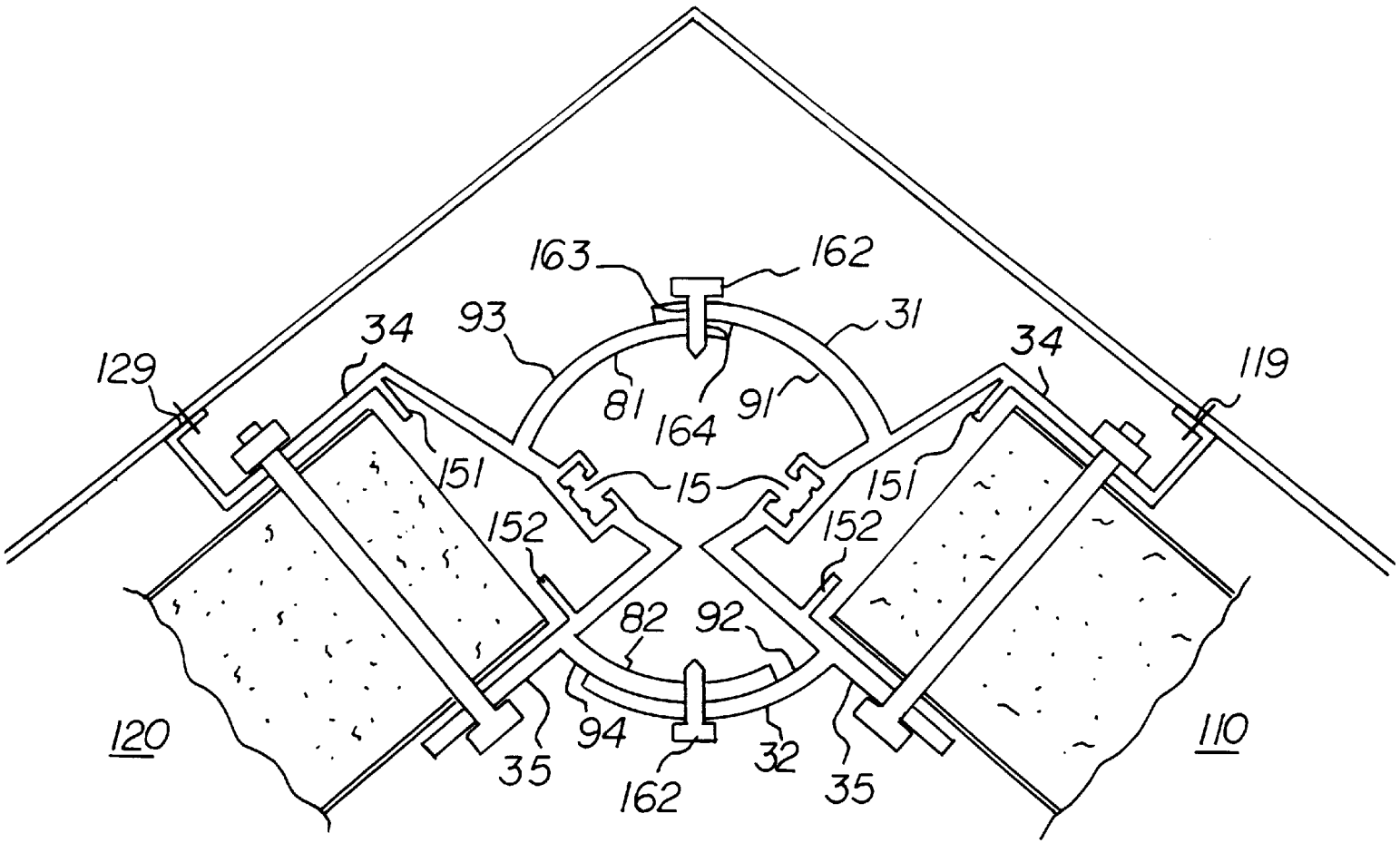
FIG. 5*d* depicts the cross section of all pieces of the ridge apparatus assembled.

Making reference to FIG. 5*d,* which is the cross section of an assembled roof ridge connector, it can be seen that the outer arch flanges (31, 32) and the inner arched sleeves (81, 82) are adapted to rotate about one another within a reasonable range of rotation. The above-described angled base members (30, 50) facilitate this relationship by allowing greater angles through which the rotation may occur.

Making further reference to FIG. 5*d,* it can be seen that locking means are applied to the cooperating pairs of sleeves (31, 81), or (32, 82). In the preferred embodiment such locking means comprise a self-threading screw (165) positioned through a pilot hole drilled through the outer and inner sleeves. In alternate embodiments, a bolt could be passed through a hole drilled in the outer sleeve (31) and a corresponding hole drilled in an inner sleeve (81). Said locking means are utilized for both sleeve pairs and spaced at eighteen inch intervals.

Figure 6B:
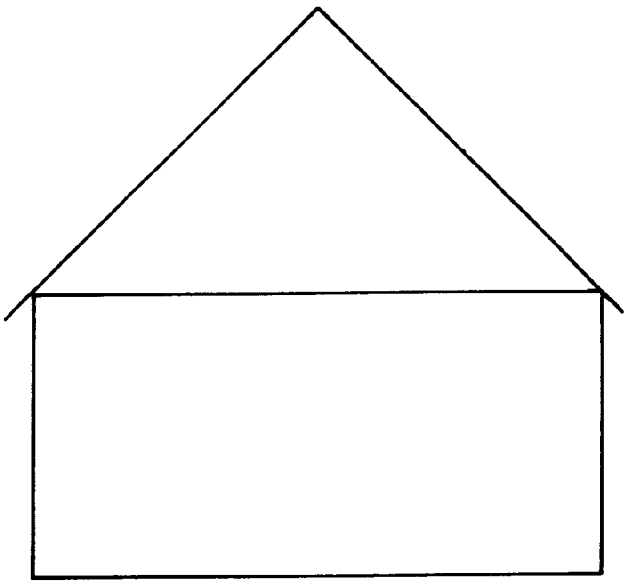
FIGS. 5*b* and 6*b* depict roofs of varying pitch.

It may now be seen that the cooperating roof ridge connecting members rotate about one another so as to accommodate a wide range of pitches for the roof. Of course, it should also be seen that these maximum and minimum pitch angles could be selected to fall within the range of pitches from 3:12 to 12:12, which are generally the minimum and maximum acceptable pitches used with standard roof construction. FIGS. 5*b* and 6*b* depict two roofs of varying pitch, but which comprise the same roof member components, particularly referring to the respective roof ridge beam and eave hinge assembly components and roof panels.

While the following description will seek to improve understanding of the invention by describing the various components and elements, it should be considered that certain apparatus may be sufficiently and adequately explained by the accompanying drawings, which are fully incorporated herein, and not require further description. All such apparatus should be considered as part of the specification of the invention for all purposes.

It should be noted that those configurations of the present invention which provide for fasteners to be passed through both sides of a frame and an enclosed structural panel utilize the practice of through-bolting. Such improves the ability of the frame to handle both positive and negative wind loads and uplift force.

Further modification and variation can be made to the disclosed embodiments without departing from the subject and spirit of the invention as defined in the following claims. Such modifications and variations, as included within the scope of these claims, are meant to be considered part of the invention as described.

What is claimed is:

1. A building system from a panel assembly and a connector assembly comprising, in combination:

a plurality of panels fabricated of a rigid elastomeric material with thermal insulating capabilities, each of the panels being clad on opposite parallel faces with a heavy gauge metal, the panels including roof panels with a periphery therearound and intermediately angled with respect to each other to form a linear ridge at the top, the panels also including vertically disposed wall panels with upper edges thereof positioned adjacent to the periphery of the roof panels, the wall panels also having lower edges couplable with respect to a fixed base, the wall panels also having window opening and door opening;

a pair of adjustable roof ridge connectors, each ridge connector having a first end in a generally U-shaped configuration with an upper side member and a parallel lower side member and an angled base member there between receiving adjacent edges of the roof panels, and each ridge connector having a second end with arched adjustment components between the roof ridge connectors, the arched adjustment components including an inner arched sleeve and an outer arched flange extending inwardly from central extents of the angled base members and an inner arched sleeve and an outer arched flange extending inwardly from the lower side members with the inner arched sleeves having a common radius of curvature and a common center of curvature between the angled base members and with the outer arched flanges having a common radius of curvature greater than the radius of curvature of the inner arched sleeves and a common center of curvature of the inner arched sleeves and with locking members between at least one outer arched flange and one inner arched sleeve; with locking members between at least one outer arched flange and one inner arched sleeve;

adjustable eave connectors positioned between the upper edges of the wall panels and the roof panels adjacent to the periphery, each eave connector having a first end with generally U-shaped flat faces receiving the wall panels adjacent to their upper edges, and each eave connector also having a second end coupled to the roof panels with adjustment components between the roof panels and wall panels;

base connectors positioned at the lower edges of the wall panels, each base connector having a first end with generally U-shaped flat faces receiving the wall panels adjacent to their lower edges, each base connector also having a second end with components fixably positionable with respect to a fixed base; and opening connectors for windows and doors positioned in the opening of the wall panels, each opening connectors having a first end with generally U-shaped flat faces receiving faces of the wall panels at the window openings and the door openings, each opening connector also having a second end for receiving doors and windows, respectively.

* * * * *